US008246015B2

(12) United States Patent
Schreib et al.

(10) Patent No.: US 8,246,015 B2
(45) Date of Patent: Aug. 21, 2012

(54) STEAM INJECTION HEATER WITH STATIONARY END SEAL ASSEMBLY

(75) Inventors: Kurt R. Schreib, Mukwonago, WI (US); Jim Zaiser, Elm Grove, WI (US)

(73) Assignee: Hydro-Thermal Corporation, Waukesha, WI (US)

( * ) Notice: Subject to any disclaimer, the term of this patent is extended or adjusted under 35 U.S.C. 154(b) by 473 days.

(21) Appl. No.: 12/497,228

(22) Filed: Jul. 2, 2009

(65) Prior Publication Data

US 2010/0001419 A1 Jan. 7, 2010

Related U.S. Application Data

(60) Provisional application No. 61/078,075, filed on Jul. 3, 2008.

(51) Int. Cl.
*B01F 3/04* (2006.01)

(52) U.S. Cl. .... 261/76; 261/116; 261/124; 261/DIG. 10

(58) Field of Classification Search ..... 261/76, 261/77, 116, 124, DIG. 10
See application file for complete search history.

(56) References Cited

U.S. PATENT DOCUMENTS

| | | | | |
|---|---|---|---|---|
| 3,197,337 | A | 7/1965 | Schink | |
| 6,082,712 | A | 7/2000 | Cincotta et al. | |
| 6,361,025 | B1 | 3/2002 | Cincotta et al. | |
| 7,152,851 | B2 * | 12/2006 | Cincotta | 261/64.1 |

FOREIGN PATENT DOCUMENTS

EP 1 688 691 A2 8/2006

OTHER PUBLICATIONS

PCT Search Report dated Sep. 28, 2009.

* cited by examiner

*Primary Examiner* — Robert A Hopkins
(74) *Attorney, Agent, or Firm* — Andrus, Sceales, Starke & Sawall, LLP

(57) ABSTRACT

A direct contact steam injection heater that includes a steam diffuser having a plurality of steam diffusion holes that are selectively exposed by a regulating member to control the amount of steam used to heat a liquid. The regulating member is movable within the steam diffuser and the steam diffuser includes a seating member to prevent the flow of steam from the diffuser when the regulating member is in a completely closed, seated position. At least one sealing members selectively exposes the steam diffusion holes in the discharge region of the steam diffuser when the regulating member moves between the open and closed positions. The spacing of the steam diffusion holes along the steam diffuser can be varied depending upon the desired resolution of the steam released as the regulating member moves between its fully closed and fully open position.

22 Claims, 4 Drawing Sheets

STEAM INJECTION HEATER WITH STATIONARY END SEAL ASSEMBLY

CROSS-REFERENCE TO RELATED APPLICATION

The present application is based on and claims priority to U.S. Provisional Patent Application Ser. No. 61/078,075 filed on Jul. 3, 2008.

BACKGROUND OF THE INVENTION

The present invention relates to direct contact steam injection heaters. More specifically, the present invention relates to an improvement for controlling the amount of steam flow into the liquid being heated while also providing a liquid tight seal during a completely closed condition.

In direct contact steam injection heaters, steam and/or any other gaseous elements are directly mixed with a liquid being heated, or in some cases with a slurry being heated. Direct contact steam injection heaters are very effective at transferring heat energy from steam to the liquid. The injection heater provides rapid heat transfer with virtually no heat loss to atmosphere, and also transfers both the latent and the available sensible heat of the steam to the liquid.

The present invention was developed during ongoing development efforts by the assignee in the field of direct contact steam injection heaters. U.S. Pat. Nos. 5,622,655; 5,842,497; 6,082,712; 6,361,025 and 7,152,851 all represent some of the prior art developments in direct contact steam injection heaters by the assignee, and are hereby incorporated by reference.

SUMMARY OF THE INVENTION

The present invention is a direct contact steam injection heater in which steam is injected through a plurality of relatively small steam diffusion holes in a steam diffuser into a liquid flowing through a combining region in a heater body. The combining region has an inlet for the liquid and an outlet for the heated liquid. The steam diffuser is generally coaxial with and resides within the combining region. Steam radially exits through the plurality of steam diffusion holes at a generally sonic velocity into the liquid flow. The small radial jets of steam into the axial flow of liquid within the combining region enhance mixing of the liquid and steam.

The steam diffuser includes a discharge region having the plurality of steam diffusion holes spaced in either an even or staggered pattern. A regulating member is positioned within the steam diffuser to regulate the amount of steam exiting the steam diffuser. Specifically, the regulating member exposes an increasing number of the steam diffusion holes to the flow of steam as the regulating member moves from a completely closed, seated position to a fully open position.

The regulating member includes a lower, seating surface that contacts a seating member formed as part of the steam diffuser. The interaction between the seating member and the sealing surface of the regulating member creates an end seal that prevents the flow of steam past the seating member when the regulating member is in its completely closed position. The regulating member may also include a first sealing member and a second sealing member that are positioned on opposite sides of the discharge region of the steam diffuser when the regulating member is in its completely closed, seated position.

As the regulating member moves away from the completely closed, seated position, the seating surface formed on the regulating member moves out of contact with the seating member positioned along the bottom, inside surface of the steam diffuser. Once the regulating member has moved away from the seating member, steam is allowed to flow between the regulating member and the outer wall of the steam diffuser, thereby allowing steam to reach the discharge region and ultimately be discharged through the plurality of steam diffusion holes. As the regulating member moves away from the closed position, the first sealing member restricts the flow of steam to control the amount of steam reaching the discharge region when the regulating member is at its lower end of travel. As the regulating member continues to move closer to the fully open position, the first sealing member moves along the discharge region and exposes an increasing number of the plurality of steam diffusion holes to the flow of stream, thus increasing the amount of steam discharged from the diffuser.

In one embodiment of the invention, the series of steam diffusion holes formed in the steam diffuser are spaced from each other by a constant distance along a helical path extending from the lower end of the discharge region to an upper end of the discharge region. The equal spacing between the steam diffusion holes in such an embodiment allows for a constantly increasing number of the steam diffusion holes to be exposed as the regulating member moves from the closed position to the fully open position.

In an alternate embodiment, the steam diffusion holes can be irregularly spaced from each other along the helical path defined in the discharge region. In such embodiment, the steam diffusion holes can be spaced closer together near the center of the helical path to provide enhanced resolution as the regulating member exposes these holes during its movement. Alternatively, the steam diffusion holes can be more closely spaced either closer to the lower end of the discharge region or closer to the upper end of the discharge region. In an embodiment in which the steam diffusion holes are closely spaced near the lower end of the discharge region, small movement of the regulating member away from the fully closed position will provide enhanced resolution. Alternatively, in an embodiment in which the steam diffusion holes are closely spaced near the upper end of the discharge region, the regulating member has enhanced resolution near the fully open position.

Other features and advantages of the invention will be apparent upon inspecting the drawings and the following description thereof.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
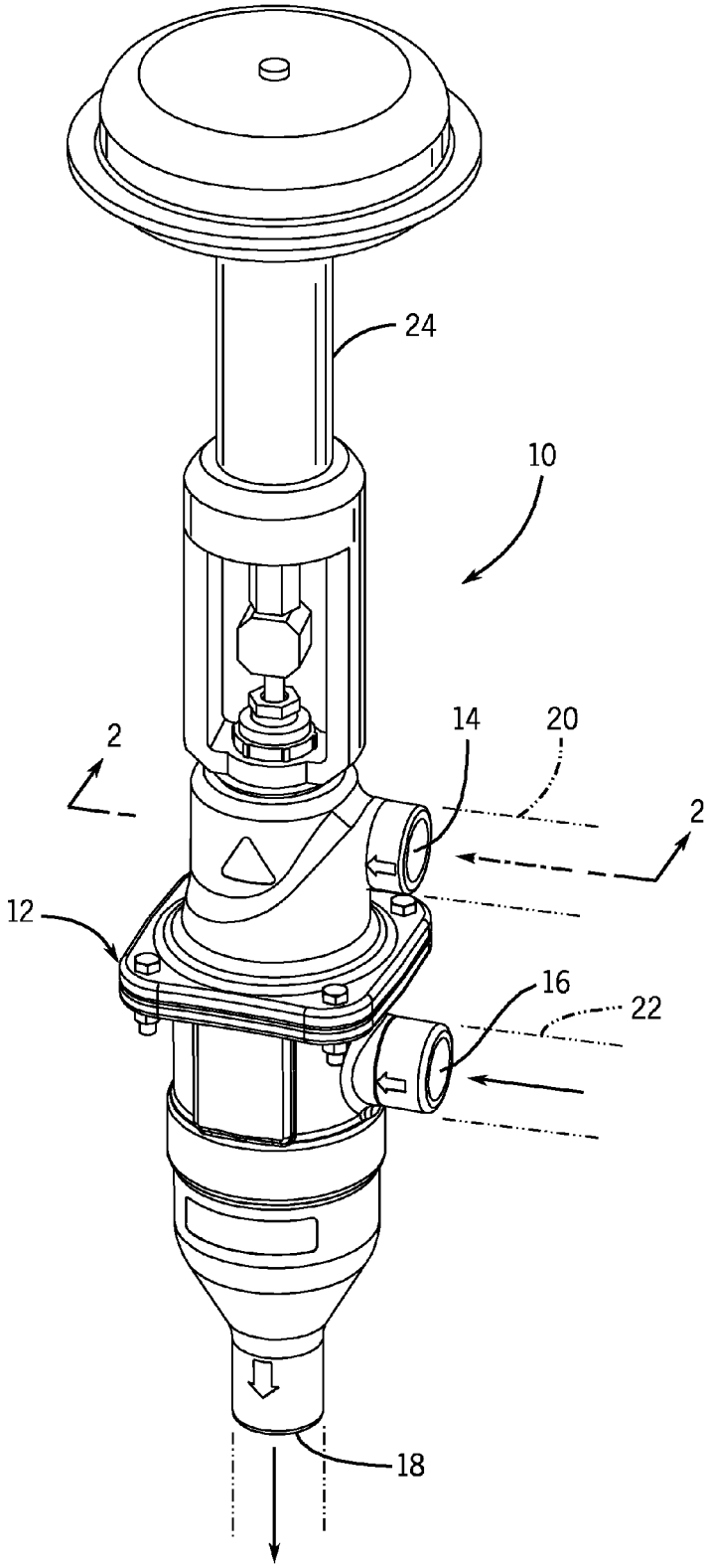
FIG. 1 is a perspective view of the direct contact steam injection heater of the present invention.

FIG. 1 generally shows a direct contact steam injection heater 10 constructed in accordance with the present invention. The injection heater 10 has a heater body 12 that includes a steam inlet 14, a liquid inlet 16 and a heated liquid product discharge outlet 18. Steam flows into the steam inlet 14 from a supply pipe 20. A liquid or slurry product to be heated enters the heater body 12 through an inlet pipe 22 that is coupled to the liquid inlet 16. As the liquid flows through the steam injection heater 10, a flow of steam is injected into the liquid flow such that the liquid flow is heated prior to exiting the heater body 12 at the heated liquid outlet 18.

As illustrated in FIG. 1, the steam injection heater 10 includes an actuator 24 that controls the amount of steam injected into the liquid flow in the manner to be described in greater detail below.

Figure 2:
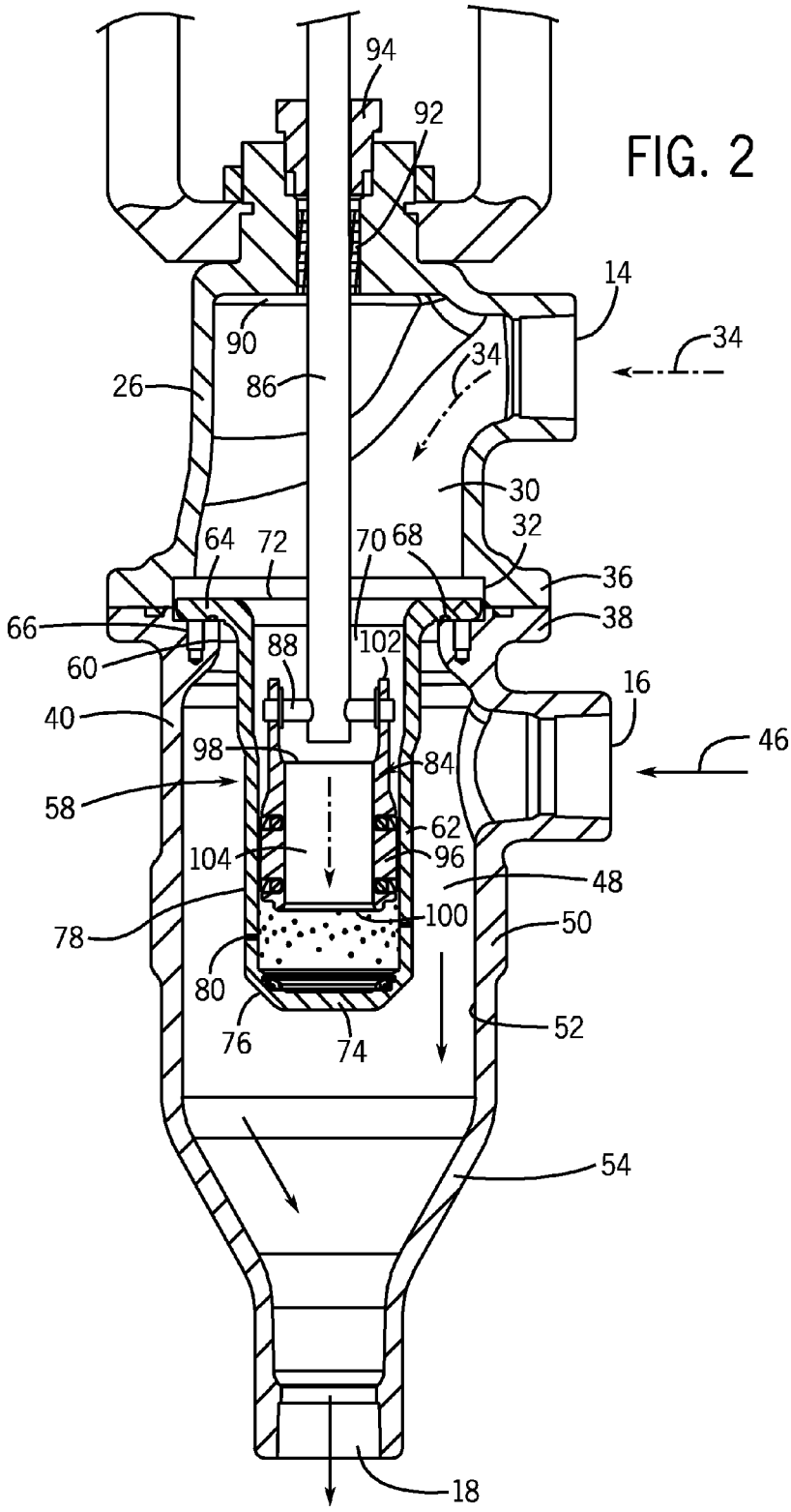
FIG. 2 is a cross section view of the direct contact steam injection heater of the present invention.

Referring now to FIG. 2, the steam inlet 14 is formed as a portion of a steam housing 26. The steam housing 26 has a generally open interior 30 that defines a lower opening 32. As steam enters into the steam housing 26, the flow of steam is directed toward the lower opening 32, as illustrated by arrows 34.

The steam housing 26 includes an attachment flange 36 that is positioned in contact with a similar attachment flange 38 formed as part of the liquid housing 40.

As illustrated in FIG. 2, the liquid housing 40 includes the liquid inlet 16. The flow of liquid, as represented by arrow 46, is directed into a combining region 48 generally defined by the open interior of the liquid housing 40. The combining region 48 is generally an open interior of the heater body 12. In general, the combining region 48 is defined by the generally cylindrical outer wall 50 and has an internal diameter defined by the inner wall surface 52. The flow of liquid passes through the combining region 48 and reaches the inwardly sloping lower wall 54 that directs the flow of fluid toward the heater liquid outlet 18.

A steam diffuser 58 is mounted across the upper opening 60 of the liquid housing 40 in axial alignment with the lower opening 32 of the steam housing 26. The steam diffuser 58 includes an outer wall 62 extending from an upper attachment flange 64. The attachment flange 64 includes a plurality of connectors 66 to secure the steam diffuser 58 to an attachment surface 68 extending around the upper opening 60. The outer wall 62 of the steam diffuser 58 is generally cylindrical and defines an open interior 70. The open interior 70 extends from an open upper end 72 to an end wall 74. The end wall 74 is joined to the side wall 62 by an angular wall 76.

The steam diffuser 58 includes a discharge region 78 formed in the outer wall 62 slightly above the end wall 74. As can best be seen in FIG. 3, the discharge region 78 extends from a lower end 77 to an upper end 79 that are each generally illustrated by dashed lines in FIGS. 3 and 4. The discharge region 78 includes a plurality of steam diffusion holes 80 that each extend through the outer wall 62 to provide a flow passageway between the open interior 70 of the steam diffuser 58 and the combining region 48 such that steam can flow into the combining region 48 through the steam diffusion holes 80, as illustrated by arrows 82 in FIG. 6.

Figure 3:
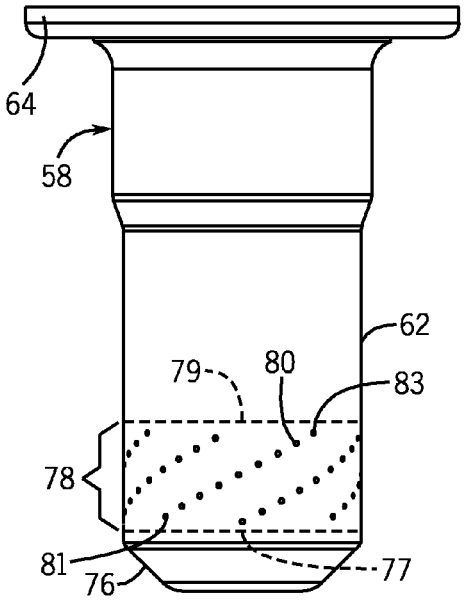
FIG. 3 is a side view of the steam diffuser illustrating the helical pattern of the steam diffusion holes.

As illustrated in FIG. 3, the steam diffusion holes 80 in the discharge region 78 are arranged in a pattern. In the embodiment shown, the steam diffusion holes 80 are arranged in a helical pattern. However, other patterns are contemplated as being within the scope of the present disclosure.

In the embodiment shown in FIG. 3, the steam diffusion holes 80 are shown as equally spaced along the generally helical pattern from the lower end 77 to the upper end 79. In the alternate embodiment of FIG. 4, the steam diffusion holes 80 are unequally spaced along the helical pattern. Specifically, in the embodiment of FIG. 4, as the steam diffusion holes 80 get further away from the lowermost hole 81, the steam diffusion holes 80 become more closely spaced until the steam diffusion holes reach the uppermost steam diffusion hole 83. Alternatively, the steam diffusion holes 80 could be more closely spaced at some other point between the lower steam diffusion hole 81 and the upper steam diffusion hole 83.

As illustrated in FIG. 3, the plurality of steam diffusion holes 80 are helically arranged along the outer wall 62. As will be described below, the amount of steam supplied by the steam diffuser 58 into the liquid flowing through the combining region 78 can be modulated by moving a regulating member 84 to expose an increasing number of steam diffusion holes 80.

Referring back to FIG. 2, steam injection heater 10 includes a regulating member 84 removably positioned within the open interior 70 of the steam diffuser 58. The regulating member 84 is movable along the longitudinal axis of the steam diffuser 58 to selectively control the amount of steam flow through the steam diffusion holes 80 in the discharge region 78. The regulating member 84 is coupled to a actuation stem 86 by a retaining pin 88. The actuation stem 86 passes through a top opening 90 formed in the steam housing 26 and is coupled to the actuator 24 shown in FIG. 1. Packing material 92 surrounds the stem 86 and is held in place by a packing nut 94. The packing material 92 in combination with the packing nut 94 provide a seal around the actuator stem 86.

Figure 6:
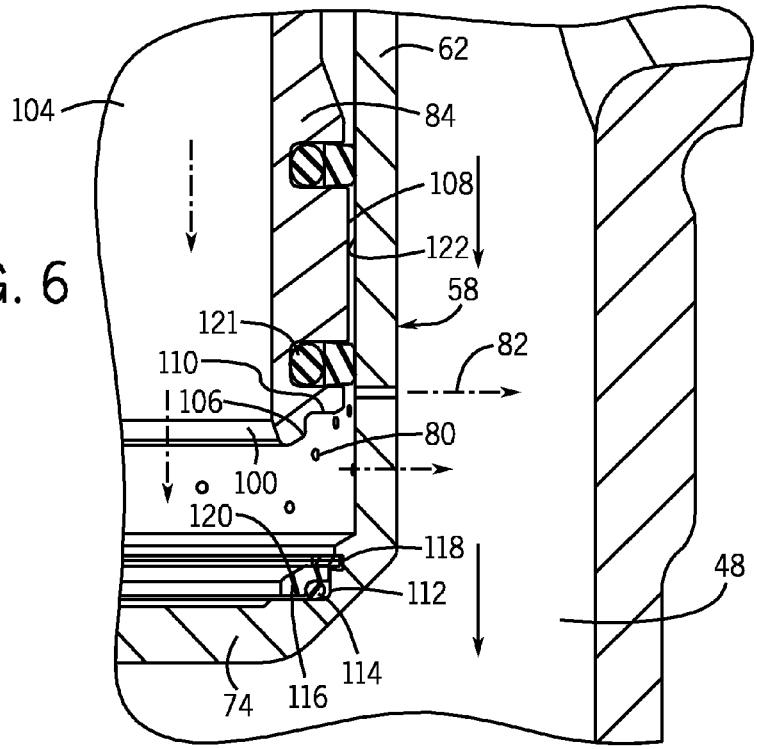
FIG. 6 is a magnified view similar to FIG. 5 illustrating the movement of the steam diffuser away from its fully closed position to a partially open position.
Figure 7:
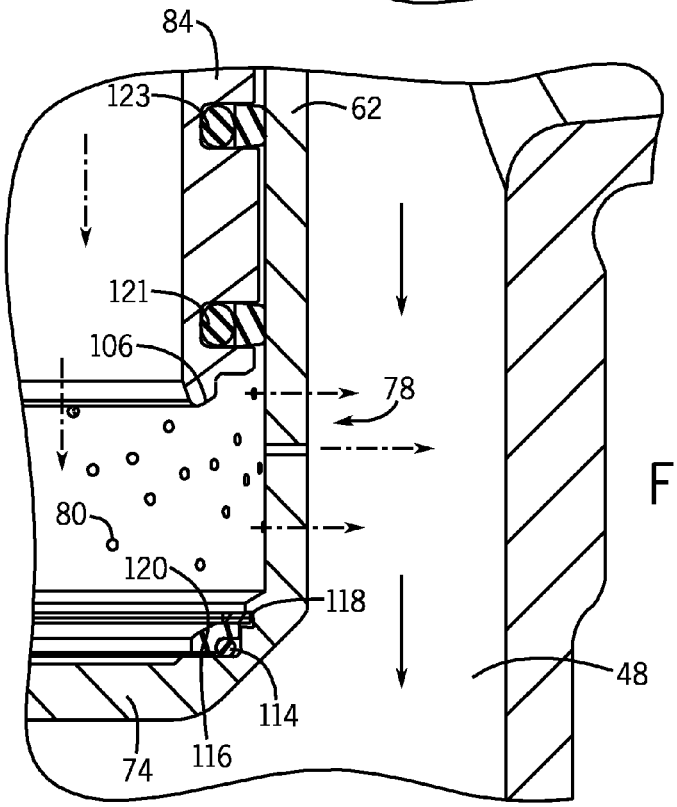
FIG. 7 is a magnified view similar to FIG. 6 illustrating the position of the regulating member in a completely open position.

Referring now to FIGS. 6 and 7, the bottom end 100 of the regulating member 84 includes a seating surface 106 that is recessed from the outer wall 108. The seating surface 106 is recessed from the outer surface to define shoulder 110.

Figure 5:
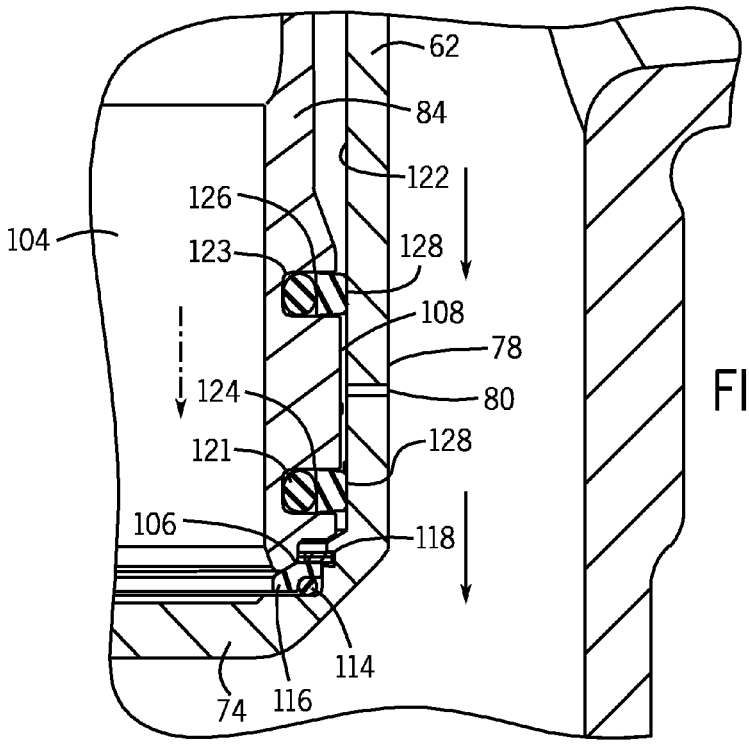
FIG. 5 is a magnified view showing the interaction between the seating surface of the regulating member and the seating member positioned along the bottom, inside surface of the steam diffuser.

As can also be seen in FIGS. 6 and 7, the end wall 74 of the steam diffuser 58 includes a recessed, receiving notch 112. The receiving notch 112 receives an O-ring 114 and a seating member 116. The O-ring 114 formed from a resilient material and provides a counter force on the seating member 116 when the seating surface 106 of the regulating member 84 is moved into contact with the seating member 116. Although the O-ring 114 is shown, other similar elements could be used to provide the counter force on the seating member 116. The O-ring 114 and seating member 116 are held in place by a retaining ring 118 that in turn is received in a recessed slot 119. In the embodiment of the invention shown in FIG. 6, the seating member 116 is an angular member having a sloped contact surface 120 that engages the seating surface 106 formed on the regulating member 84, as shown in FIG. 5. In the preferred embodiment of the invention, the seating member 116 is formed from brass, although other materials are contemplated as being within the scope of the present disclosure.

When the regulating member 84 is in its completely closed, seating position, as shown in FIG. 5, the seating member 116 creates a fluid tight end seal with the seating surface 106 that prevents the steam within the open interior 104 from passing between the outer surface 108 of the regulating member 84 and the inner surface 122 of the outer wall 62. Thus, when the regulating member 84 is in its completely closed position, the seating member 116 prevents the flow of steam from reaching the steam diffusion holes 80 in the discharge region 78.

Referring back to FIG. 5, the regulating member 84 includes a first sealing member 121 and a second sealing member 123. The first sealing member is received within groove 124 recessed from the outer surface 108 and extends around the entire outer circumference of the regulating member 84. The second sealing member 123 is received within a similar groove 126. In the preferred embodiment of the invention, both the first sealing member 121 and the second sealing member 123 are resilient, annular rings that include a contact surface 128 that engages the inner surface 122 of the outer wall 62. In the preferred embodiment of the invention, both the first sealing member 121 and the second sealing member 123 are components known as glyd rings. However, it is contemplated that different components can be utilized for the first and second sealing members 121, 123 while operating within the scope of the present invention.

When the regulating member 84 is in its completely closed, seated position, the first sealing member 121 is positioned below the discharge region 78 while the second sealing member 123 is positioned above the discharge region 78. Thus, the entire discharge region 78 is contained between the first sealing member 121 and the second sealing member 123. As described previously, when the regulating member 84 is in its completely closed, seated position, the seating member 116 prevents the flow of steam to the discharge region 78. When the regulating member 84 is fully seated, the first sealing member 121 and the second sealing member 123 provide a controlling seal to prevent the liquid flowing within the combining region 48 from entering into the steam diffuser past the discharge region 78.

As the regulating member 84 is moved axially within the steam diffuser, as shown in FIG. 6, the seating surface 106 of the regulating member 84 is moved away from the sealing member 116 such that steam is initially allowed to flow between the outer surface 108 of the regulating member 84 and the inner surface 122 of the outer wall 62. The first sealing member 121 functions as a controlling seal that allows controlled leakage of steam past the sealing member 121. Since the sealing member 121 is continuously moved along the series of steam diffusion holes 80 within the discharge region 78, the first sealing member 121 cannot be counted on to provide a liquid tight seal. Thus, the first sealing member 121 functions as a controlling member to allow a controlled leakage of steam to the discharge region 78.

As the regulating member 84 continues to move upward as shown in FIG. 7, the first sealing member 121 exposes an increasing number of the steam diffusion holes 80. When the regulating member 84 reaches a completely open position, the first sealing member 121 is positioned above the discharge region 78 to expose all of the steam diffusion holes 80 contained within the discharge region 78, thereby allowing the maximum amount of steam to reach the combining region 48.

As described previously, the first sealing member 121 allows a controlled flow of steam once the seating surface 106 of the regulating member 84 breaks contact with the sealing member 116. The first sealing member 121 prevents excessive leakage past the seal. The controlled leakage of steam past the first sealing member 121 is important such that the amount of steam exiting the steam diffuser can closely track the position of the regulating member in order to offer adequate steam control. If the amount of steam leakage past the first sealing member 121 is excessive, too much steam will flow out of the discharge region 78 and it may be impossible to control the temperature of the discharged liquid at the lower end of the regulating member travel.

Figure 4:
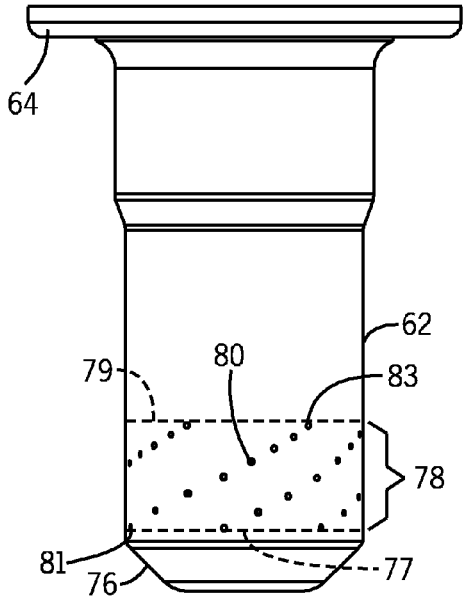
FIG. 4 is a side view of the steam diffuser illustrating the uneven spacing of the steam diffusion holes along the discharge region of the steam diffuser.

Referring now to FIGS. 3 and 4, as described previously, the spacing between the individual steam diffusion holes 80 can be varied along a helical pattern from the lower end 77 to the upper end 79, as best shown in FIGS. 3 and 4. In the embodiment shown in FIG. 3, the steam diffusion holes 80 are equally spaced from the lowermost steam diffusion holes 81 to the uppermost steam diffusion holes 83. In the embodiment shown in FIG. 4, the steam diffusion holes 80 are more closely spaced in an upper area between the lower steam diffusion hole 81 and the upper steam diffusion hole 83. The tighter spacing between the steam diffusion holes 80 along the helical pattern increases the resolution of the system at this location between the fully closed and fully open positions of the regulating member.

Although one embodiment of the spacing between the steam diffusion holes 80 is shown in FIG. 4, it should be understood that the spacing between the steam diffusion holes 80 along the helical pattern shown could be varied depending upon the system requirements. As an example, when the steam diffusion holes 80 are more closely spaced near the lowermost steam diffusion hole 81, the system provides for enhanced resolution as the regulating member begins to initially open. Conversely, when the steam diffusion holes are more closely spaced near the upper steam diffusion hole 83, the system provides greater resolution near the fully open position of the regulating member. It should be understood that various different patterns of the steam diffusion holes 80 are possible while operating within the scope of the present disclosure.

While the preferred embodiment of the invention has been shown in connection with FIGS. 1-7, it should be noted that the invention is not limited to this specific embodiment. For example, while the drawings show a regulating member having a generally piston-like shape, it is contemplated that the regulating member could have different shapes and be movable in different manners to selectively expose a number of the steam diffusion holes 80 within the discharge region 78.

We claim:

1. A direct contact steam injection heater comprising:

a heater body having a steam inlet, a liquid inlet, and a heated liquid outlet;

a steam diffuser positioned at the steam inlet to receive a flow of steam from the steam inlet, the steam diffuser having a generally cylindrical outer wall joined to an end wall;

a discharge region formed in a portion of the steam diffuser, the discharge region including a plurality of steam diffusion holes through which steam is discharged from the steam diffuser;

a regulating member movably positioned within the steam diffuser to control the discharge of steam from the discharge region, the regulating member having an open interior defined by a cylindrical outer wall extending between an open top end and an open bottom end, wherein the bottom end of the outer wall defines a seating surface, wherein the open interior of the regulating member receives the flow of steam; and a resilient, stationary seating member positioned along the end wall of the steam diffuser, wherein the seating surface on the regulating member contacts the seating member to create an end seal to prevent the flow of steam to the discharge region when the regulating member is in a completely closed position.

2. The injection heater of claim 1 further comprising at least a first sealing member extending around an outer surface of the regulating member, the first sealing member being in contact with the outer wall of the steam diffuser, wherein the first sealing member restricts the flow of steam passing through the open bottom end of the regulating member from reaching the steam diffusion holes in the discharge region.

3. The injection heater of claim 2 wherein the regulating member is movable from the completely closed position to an open position, wherein the first sealing member restricts the flow of steam between the outer surface of the regulating member and the outer wall of the steam diffuser.

4. The injection heater of claim 3 wherein the first sealing member is positioned such that an increasing area of the discharge region is exposed to the flow of steam as the regulating member moves from the closed position to the open position.

5. The injection heater of claim 1 wherein the seating member is a resilient ring received in a recessed receiving notch formed near the end wall of the steam diffuser.

6. The injection heater of claim 5 wherein the seating member is held within the receiving notch by a retaining ring, wherein the retaining ring is received within a recessed slot formed in the steam diffuser.

7. The injection heater of claim 2 further comprising a second sealing member extending around the outer surface of the regulating member and spaced from the first sealing member, wherein the discharge region is positioned between the first sealing member and the second sealing member when the regulating member is in the completely closed position.

8. The injection heater of claim 2 wherein the regulating member is a piston positioned to receive the flow of steam at the open top end and discharge the flow of steam through the open bottom end, wherein the first sealing member is positioned around an outer circumference of the piston, wherein the first flow seal exposes an increasing number of steam diffusion holes in the discharge region to the flow of steam as the piston moves from the closed position to the open position.

9. The injection heater of claim 1 wherein the plurality of steam diffusion holes formed in the discharge region are formed in a pattern extending from a lower end of the discharge region to an upper end of the discharge region.

10. The injection heater of claim 9 wherein the plurality of steam diffusion holes are evenly distributed along the pattern from the lower end to the upper end of the discharge region.

11. The injection heater of claim 9 wherein the pattern is a helical pattern from the lower end to the upper end.

12. The injection heater of claim 11 wherein the plurality of steam diffusion holes are evenly distributed along the helical pattern from the lower end to the upper end of the discharge region.

13. The injection heater of claim 11 wherein the plurality of steam diffusion holes are unevenly distributed along the helical pattern from the lower end to the upper end of the discharge region.

14. A direct contact steam injection heater comprising:

a heater body having a steam inlet, a liquid inlet, and a heated liquid outlet;

a steam diffuser positioned at the steam inlet to receive a flow of steam from the steam inlet, the steam diffuser having a generally cylindrical outer wall joined to an end wall;

a discharge region formed in a portion of the steam diffuser, the discharge region including a plurality of steam diffusion holes through which steam is discharged from the steam diffuser, the steam diffusion holes being formed in a pattern extending from a lower end of the discharge region to an upper end of the discharge region, wherein the plurality of steam diffusion holes are unevenly distributed along the pattern from the lower end to the upper end of the discharge region;

a regulating member movably positioned within the steam diffuser to control the discharge of steam from the discharge region, the regulating member having an open interior defined by a cylindrical outer wall extending between an open top end and an open bottom end, wherein the bottom end of the outer wall defines a seating surface, wherein the open interior of the regulating member receives the flow of steam; and a resilient, stationary seating member positioned along the end wall of the steam diffuser, wherein the seating surface on the regulating member contacts the seating member to create an end seal to prevent the flow of steam to the discharge region when the regulating member is in a completely closed position.

15. A direct contact steam injection heater comprising:

a heater body having a steam inlet, a liquid inlet and a heated liquid outlet;

a steam diffuser positioned at the steam inlet to receive a flow of steam from the steam inlet, the steam diffuser having a generally cylindrical outer wall joined to an end wall;

a discharge region formed in a portion of the steam diffuser, the discharge region extending from a lower end to an upper end, the discharge region including a plurality of steam diffusion holes arranged in a pattern from the lower end to the upper end, wherein steam is discharged from the steam diffuser through the pattern of steam diffusion holes; and a regulating member movably positioned within the steam diffuser, the regulating member having an open top end to receive the flow of steam and an open bottom end to direct the flow of steam into the steam diffuser, wherein the steam diffusion holes are unequally spaced from each other along the pattern from the lower end to the upper end.

16. The injection heater of claim 15 wherein the steam diffusion holes are more closely spaced near the lower end of the pattern than the upper end of the pattern.

17. The injection heater of claim 15 wherein the steam diffusion holes are more closely spaced near the upper end of the pattern than the lower end of the pattern.

18. The injection heater of claim 16 wherein the pattern is a helical pattern.

19. The injection heater of claim 17 wherein the pattern is a helical pattern.

20. The injection heater of claim 15 further comprising at least a first sealing member extending around an outer surface of the regulating member and in contact with an inner surface of the outer wall of the steam diffuser, wherein the first sealing member moves along the discharge region when the regulating member is moved from the closed position to an open position to selectively expose an increasing number of steam diffuser holes.

21. The injection heater of claim 20 further comprising a seating member positioned along the end wall of the steam diffuser, wherein the seating member creates an end seal with a sealing surface formed on the open bottom end of the regulating member.

22. The injection heater of claim 21 wherein the seating member is received within a recess formed in the steam diffuser and is held in place by a retaining ring.

* * * * *